United States Patent [19]

Drinon

[11] 4,391,405

[45] Jul. 5, 1983

[54] CONTAINER

[75] Inventor: Alva C. Drinon, Portland, Me.

[73] Assignee: Weyerhaeuser Company, Tacoma, Wash.

[21] Appl. No.: 314,262

[22] Filed: Oct. 23, 1981

[51] Int. Cl.[3] ..... B65D 5/24; B65D 5/34

[52] U.S. Cl. ..... 229/31 R; 229/33; 229/38

[58] Field of Search ..... 229/31 R, 31 FS, 32, 229/33, 44 R, 38

[56] References Cited

U.S. PATENT DOCUMENTS

| | | | |
|---|---|---|---|
| 3,073,440 | 1/1963 | Jones | 229/31 R |
| 3,820,706 | 6/1974 | Gibson | 229/31 FS |
| 3,840,172 | 10/1974 | Zimmermann | 229/44 R |
| 3,871,570 | 3/1975 | Garmon | 229/31 R |
| 3,942,712 | 3/1976 | Bundy | 229/44 R |
| 4,119,265 | 10/1978 | Dlungopolski | 229/31 R |
| 4,208,007 | 6/1980 | Bamburg | 229/31 R |
| 4,306,658 | 12/1981 | Montealegre | 229/31 R |

FOREIGN PATENT DOCUMENTS

| | | | |
|---|---|---|---|
| 490538 | 8/1938 | United Kingdom | 229/44 R |

*Primary Examiner*—Herbert F. Ross

[57] ABSTRACT

The present box is designed to be formed into an erect container without the need for staples or tape to hold the container together. The container corners are formed by gusset panels. These gusset panels have locking tabs which are held in place by locking panels attached to the side panels. The locking panels are held in place by locking indentations or apertures on the front and rear panels which mate with second locking tabs in the locking panels. A container cover is also formed without the need of tape or staples to hold the cover elements together. The side cover panels have front interior panels which extend along the front edge of the container. The cover front wall wraps around the front interior panels and locking tabs on the interior panel of the front cover insert into apertures. The apertures are in a locking tab hinged to the upper edge of said interior front flap.

20 Claims, 4 Drawing Figures

CONTAINER

BACKGROUND OF THE INVENTION

1. Field of the Invention

A container, which is formed of interlocking members which hold the container in position without the use of tape or staples, may be assembled by hand.

2. Other Disclosures

Containers with gusset corners have been used for holding viscous or liquid materials. U.S. Pat. No. 3,904,105 shows a tray locking construction.

SUMMARY OF THE INVENTION

The present box is designed to be formed into an erect container without the need for staples or tape to hold the container together. The container corners are formed by gusset panels. These gusset panels have locking tabs which are held in place by locking panels attached to the side panels. The locking panels are held in place by locking indentations or apertures on the front and rear panels which mate with second locking tabs on the locking panels.

A container cover is also formed without the need of tape or staples to hold the cover elements together. The side cover panels have front interior panels which extend along the front edge of the container. The cover front wall wraps around the front interior panels and locking tabs on the interior panel of the front cover insert into apertures. The apertures are be in a locking tab hinged to the upper edge of said interior front flap.

DESCRIPTION OF THE PREFERRED EMBODIMENT

Figure 1:
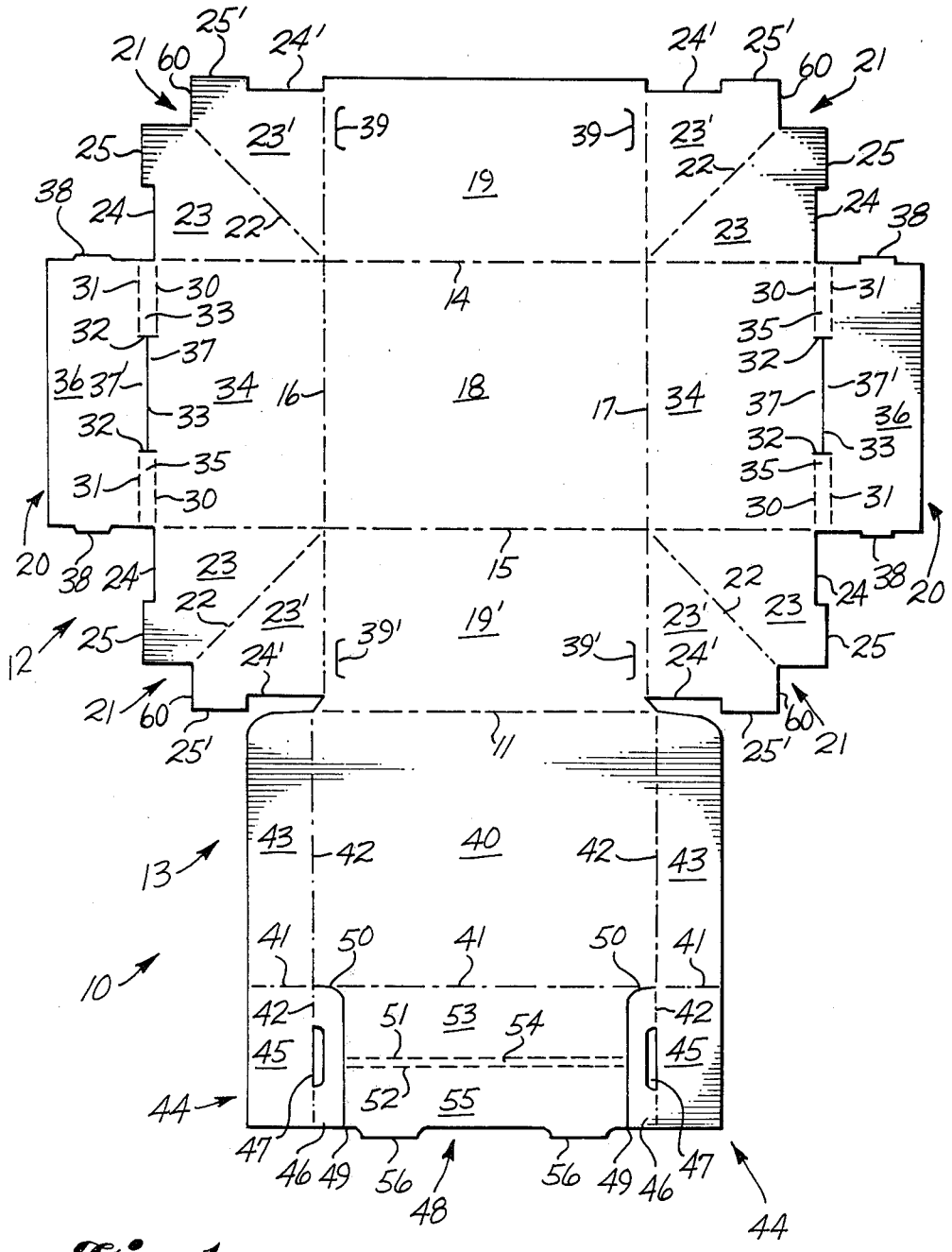
FIG. 1 is a top plan view of the blank for the container.
Figure 2:
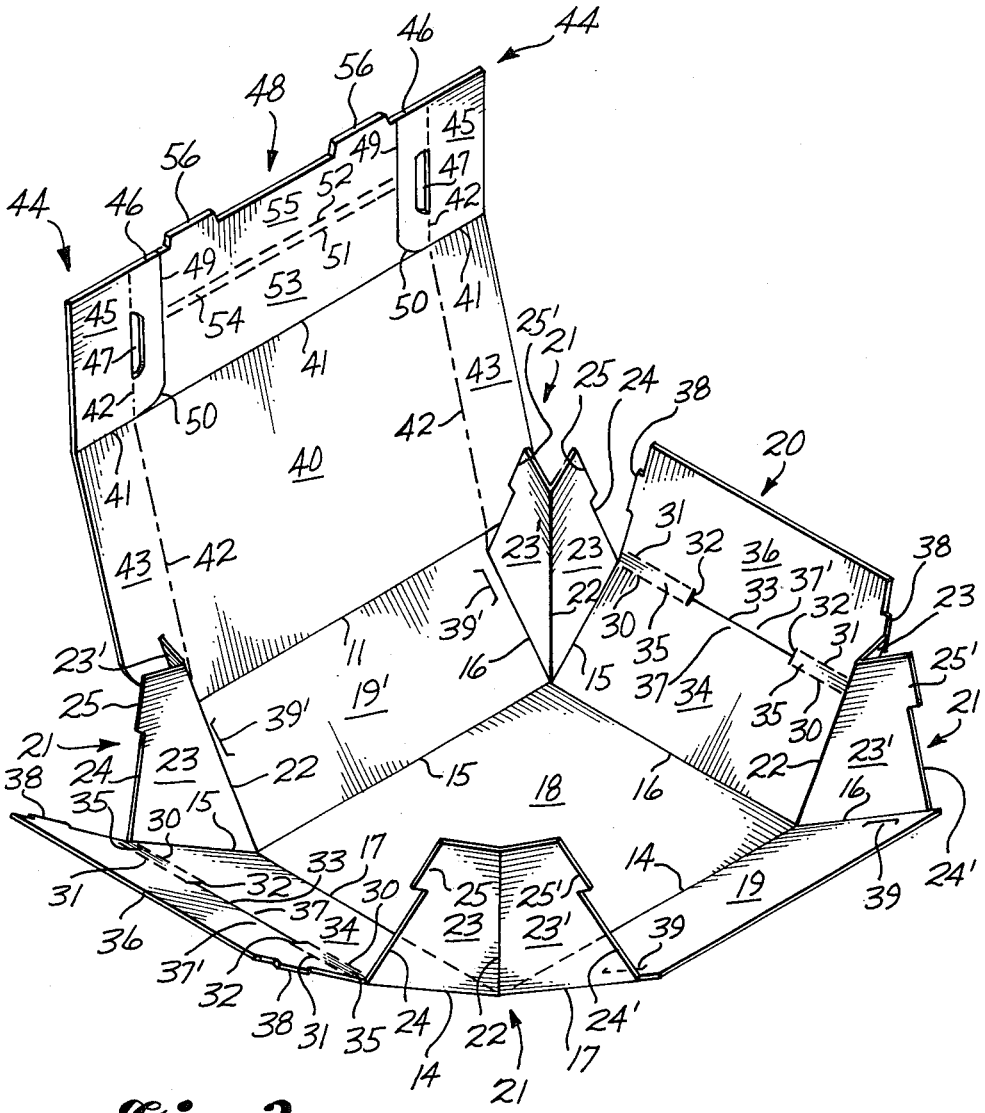
FIG. 2 is an isometric view showing the container body being folded into position.
Figure 3:
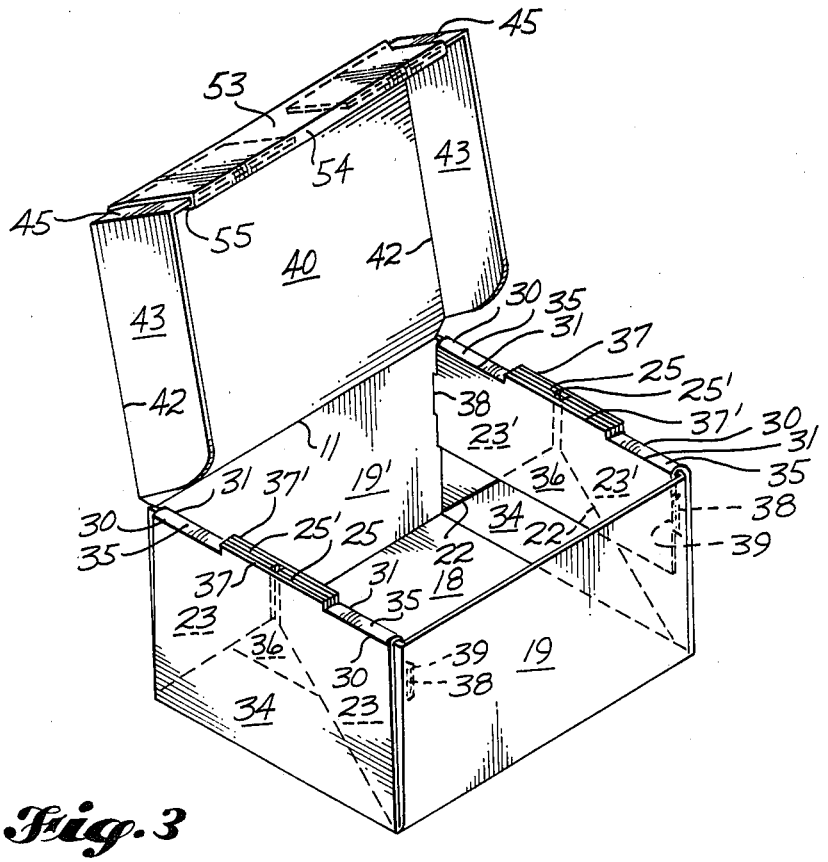
FIG. 3 is an isometric view of the container with the body section folded in direct position and the cover section folded into completed position.

Blank 10 is divided by score line 11 into a body section 12 and a cover section 13.

The body section 12 is divided by transverse score lines 14 and 15 and longitudinal score lines 16 and 17 into a base panel 18, a front panel 19, a rear panel 19', side sections 20 and corner panels 21.

The corner panels 21 are identical so like reference numerals are used for each of the panels. Each of the panels 21 is divided by a diagonal score line 22 extending from the intersection of the longitudinal and transverse score lines defining the two interior side edges of the panel. The score line 22 divides the corner panel 21 into two partial gusset panels—interior gusset panel 23 and exterior gusset panel 23'. The terms interior and exterior will be defined during the description of forming the container. Each of the gusset panels has an outer relief 24 or 24' which defines an outer locking tab 25 or 25'. The outer corner of panel 21 is also relieved at 60 to define the outer edge of locking tabs 25 and 25'. The size or presence of relief 60 will depend on the height and width of the container.

The two side panels 20 are also identical and have identical reference numerals. The panels 20 are divided by parallel score lines 30 and 31 and associated cut lines 32 and 33 into an exterior side panel 34, upper shoulder panels 35 and an interior locking panel 36. The cut lines 32 and 33 also define upper tabs 37 and 37' on the upper edges of exterior side panel 34 and locking panel 36. The upper tabs 37 and 37' may be eliminated, and the side panel 34 and locking panel 36 may be separated by a slot instead of a slit. It does not matter which type of cut is used. The locking panel 36 also has a pair of locking tabs 38 extending from the side edges of the panel.

In forming the body of the container, the front and rear panels 19 and 19' and the side panels 20 are bent upwardly around score lines 14, 15, 16 and 17. The corner panels bend inwardly around score line 22. When the front and rear panels and side panels 34 are in an upright position, their side edges defined by score lines 14, 15, 16 and 17 are touching, and each of the pairs of gusset panels 23 and 23' are contiguous. The relief sections formed by 24 and 24' are the same height and the tabs 25 and 25' coincide.

The corner panels are then bent around their score lines until the interior face of exterior panel 23 is contiguous with the interior face of side panel 34. The locking tabs 25, 25' are aligned with the tab 37. The score line 30 is aligned with or slightly higher than the relief 24, 24'. The shoulder panels 35 are then bent inwardly around score line 30 over the relief section 24, 24' and the locking panel 36 is bent downwardly around score lines 31 to lock the shoulder panels 35 around the locking tabs 25, 25' holding these tabs and their associated corner panels in place. The upper edge of locking panels 25, 25' coincide with the upper edge of tabs 37 and 37'.

The locking tabs 25, 25' are shown on the outer edge of gusset panels 23, 23'. They may be located at other places on the upper edge of the gusset panel. The shoulder panels 31 would be relocated to accommodate the locking tabs.

The locking tabs 38 are then forced into the locking indentations 39 and 39' formed on front and rear panels 19 and 19', respectively. This holds the container body upright. Apertures may be used in place of the indentations.

The top cover panel 40 of cover section 13 is defined by transverse score line 41 and longitudinal score lines 42. The top cover panel 40 is hinged to the body section 12 by score line 11. The cover section 13 has no other connection with the body section 12 except along score line 11.

A pair of side cover panels 43 are hingedly attached to the sides of top cover panel 40 along score lines 42. In the formed container the side cover panels 43 are bent upwardly around score line 42 to form side panels on the top cover panel 40.

A pair of interior cover locking sections 44 are hingedly attached to the front edge of side cover panels 43 along score line 41. Each of the interior locking sections 44 is divided by score line 42 into an interior front cover panel 45 and an interior locking tab 46. Within the interior locking tab 46 is locking aperture 47. The aperture 47 extends along the score line 42.

A front cover section 48 is hingedly attached to the front edge of top cover panel 40 along score line 41. The front cover section 48 does not extend the full width of panel 40 because the interior locking tabs 46 are formed from its side edges. The front cover section 48 and the interior locking tabs 46 are separated by cut lines 49 and 50, cut line 49 being substantially parallel and to the interior of score line 42 and cut line 50 extending from cut line 49 to the intersections of score line 41 and score line 42. The cut line 50 may be rounded or beveled if desired.

The front cover section 48 is divided by transverse score lines 51 and 52 into an exterior front cover panel 53, a bottom shoulder panel 54 and an interior locking panel 55. The locking panel 55 has a pair of locking tabs 56 on its outer edge. The height of exterior panel 53 is equal to the height of side panels 43.

Figure 4:
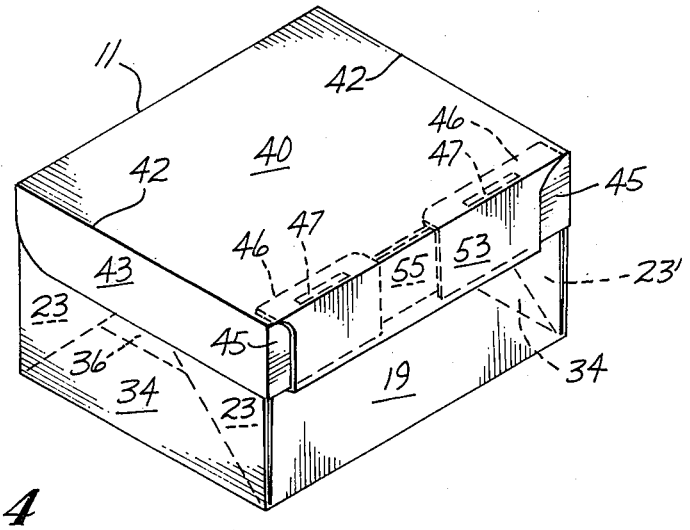
FIG. 4 is an isometric view of the closed container.

In forming the cover the side cover panels 43 are bent upwardly around score lines 42. The interior locking tabs 46 are bent upwardly around score line 42 and the interior front cover panels 45 bent inwardly around score line 41 until the panels 45 are aligned with the front edge of the top cover panel 40. The exterior front cover panel 53 is bent upwardly around score line 41. The shoulder panel 54 is bent around score line 51 until it overlies the bottom edges of interior front cover panels 45, the interior locking panel 55 is bent inwardly around score line 52, and the locking tabs 56 are placed into the locking apertures 47 in the interior locking tabs 46. This forms the cover. The panels 43, 45 and 53 are substantially perpendicular to the top cover panel 40. The top cover panel 40 is then bent downwardly around score line 11 until it covers the container as shown in FIG. 4.

The present design may be used for a product, such as lobster, which is packed wet. The container construction is leak proof. The interior face of the double faced corrugated material should be curtain coated with a liquid barrier material such as polymer-wax blend.

I claim:

1. A blank for a container body comprising:

a rectangular base panel, front and rear panels hingedly attached along score lines to said base panel, side panels hingedly attached along score lines to said base panel, four corner panels each hingedly attached by score lines along two adjacent sides to said adjacent side panel and said adjacent one of said front and rear panels, said corner panels being divided into a pair of gusset panels by a diagonal score line extending from the juncture of said hinged score line of said corner panel each of said gusset panels having a locking tab extending outwardly from its upper edge, said locking tabs of each pair of said gusset panels being alignable in the erect container body, a locking panel extending outwardly from each of said side panels, said locking panel being separated from said side panel by a cut line along a portion of the width of said locking panel and said side panel, said cut line separation being alignable with said locking tabs in said erect container body, said locking panel and said side panel being further separated along at least part of the remainder of their width by a pair of shoulder panels, each said shoulder panel being defined by a pair of parallel score lines which form the hinged joint between said shoulder panel and said side panel and said shoulder panel and said locking panel, said score line between said side panel and said shoulder panel being aligned substantially with the upper edge of said gusset panel, the width of said shoulder panel being substantially equal to the combined thickness of a pair of gusset panels,

2. The blank of claim 1 in which said locking tabs are on the outer edge of said gusset panels.

3. The blank of claim 1 in which said cut line is a slit between said locking panel and said side panel.

4. The blank of claim 1 in which said cut line is a slot between said locking panel and said side panel.

5. The blank of claims 1, 2, 3 or 4 in which a side edge of each said shoulder panel is positioned in said blank to be adjacent a side edge of each of said locking tabs in the erect container.

6. The blank of claim 1, 2, 3 or 4 further comprising second locking tabs on the side edges of said locking panels, locking indentations in said front and rear panels, said second locking tabs being substantially aligned with said locking indentations in said erect container.

7. The blank of claims 1, 2, 3 or 4 in which a side edge of said shoulder panel is positioned in said blank to be adjacent a side edge of each of said locking tabs in the erect container, second locking tabs on the side edges of said locking panels, locking indentations in said front and rear panels, said second locking tabs being substantially aligned with said locking indentations in said erect container.

8. The blank of claims 1, 2, 3 or 4 further comprising second locking tabs on the side edges of said locking panels, locking apertures in said front and rear panels, said second locking tabs being substantially aligned with said locking apertures in said erect container.

9. The blank of claims 1, 2, 3 or 4 in which a side edge of said shoulder panel is positioned in said blank to be adjacent a side edge of each of said locking tabs, second locking tabs on the side edges of said locking panels, locking apertures in said front and rear panels, said second locking tabs being substantially aligned with said locking apertures in said erect container.

10. A container body comprising a rectangular base panel, front and rear panels hingedly attached along score lines to said base panel and extending upwardly from said base panel, side panels hingedly attached along score lines to said base panel and extending upwardly from said base panel, four cover panels each hingedly attached by score lines along two adjacent sides to said adjacent side panel and said adjacent one of said front and rear panels, said corner panels being divided into a pair of gusset panels by a diagonal score line extending from the juncture of said hinged score line of said corner panel, said gusset panels extending inwardly of said container body along said side wall, each of said gusset panels having a locking tab extending outwardly from its upper edge, said locking tabs of each pair of said gusset panels being aligned, a locking panel extending downwardly over the inner side of said gusset panels, said locking panel being separated from said side panel by a cut line aligned with said locking tabs said locking panel and said side panel being further separated along at least part of the remainder of their width by a pair of shoulder panels, each said shoulder panel being defined by a pair of parallel score lines which form the hinged joint between said shoulder panel and said side panel, and said shoulder panel and said locking panel, said score line between said side panel and said shoulder panel being aligned substantially with the upper edge of said gusset panel, the width of said shoulder panel being substantially equal to the combined thickness of a pair of gusset panels.

11. The container body of claim 11 in which said locking tabs are on the outer edge of said gusset panels.

12. The container body of claim 10 in which said cut line is a slit between said locking panel and said side panel.

13. The container body of claim 10 in which said cut line is a slot between said locking panel and said side panel.

14. The container body of claims 10, 11, 12 or 13 in which a side edge of each said shoulder panel is adjacent a side edge of each of said locking tabs.

15. The container body of claim 10, 11, 12 or 13 further comprising second locking tabs on the side edges of said locking panels, locking indentations in said front and rear panels, said second locking tabs being inserted into said locking indentations.

16. The container body of claims 10, 11, 12 or 13 in which a side edge of said shoulder panel is adjacent a side edge of each of said locking tabs, second locking tabs on the side edges of said locking panels, locking indentations in said front and rear panels, said second locking tabs being inserted into with said locking indentations.

17. The container body of claims 10, 11, 12 or 13 further comprising second locking tabs on the side edges of said locking panels, locking apertures in said front and rear panels, said second locking tabs being inserted into said locking apertures.

18. The container body of claims 10, 11, 12 or 13 in which a side edge of said shoulder panel is adjacent a side edge of each of said locking tabs, second locking tabs on the side edges of said locking panel, locking apertures in said front and rear panels, said second locking tabs being inserted into said locking apertures.

19. A blank for a container cover comprising a top cover panel hingedly connected to said container blank, side cover panels hingedly attached to said top cover panel by first score lines normal to said container connection and along the opposite side edges of said top cover panel, interior front cover panels hingedly attached to the front edges of said side cover panels remote from said container connection along a second score line, interior locking tabs hingedly connected to the inner edge of said interior front cover panels along a third score line substantially aligned with said first score line, a locking aperture in each of said interior locking tabs adjacent to said third score line, a front cover panel hingedly connected to the front edge of said top cover panel remote from said container connection and along a fourth score line substantially aligned with said second score line, a front cover shoulder panel hingedly connected to said front cover panel along a fifth score line substantially parallel to said fourth score line, an interior front cover locking panel hingedly attached to said shoulder panel by a sixth score line, locking tabs on the outer edge of said interior front cover locking panel remote from said container connection and insertable into said locking apertures in the erect container cover.

20. A container including a cover comprising a top cover panel hingedly connected to said container, side cover panels hingedly attached normal to said top cover panel by first score lines along opposed side edges of said top cover panel, interior front cover panels hingedly attached normal to the front edges of said side cover panels along a second score line and being upright to said top cover panel, interior locking tabs hingedly connected to the upper edges of said interior front cover panels along a third score line substantially aligned with the front of said top cover panel and lying in contact with said top cover panel, a locking aperture in each of said interior locking tabs adjacent to said third score line, a front cover panel hingedly connected to the front edge of said top cover panel, a front cover shoulder panel hingedly connected to said front cover panel along a fifth score line, said front cover shoulder panel extending along the lower edges of said interior front cover panels, an interior front cover locking panel hingedly attached to said shoulder panel by a sixth score line, said interior front cover locking panel extending along the interior of said interior front cover panels, locking tabs on the distal edge of said interior front cover locking panel inserted into said locking apertures.

* * * * *